United States Patent [19]

Brown et al.

[11] Patent Number: 4,819,746

[45] Date of Patent: Apr. 11, 1989

[54] REVERSE CIRCULATION DOWN-THE-HOLE HAMMER DRILL AND BIT THEREFOR

[75] Inventors: John C. A. T. Brown, Sheffield, England; Patrick Purcell, Shannon; Peter J. Sweeny, Limerick, both of Ireland

[73] Assignee: Minroc Technical Promotions Ltd., Smithtown, Ireland

[21] Appl. No.: 134,833

[22] Filed: Dec. 18, 1987

[30] Foreign Application Priority Data

Jan. 13, 1987 [IE] Ireland ..... 73/87
Sep. 1, 1987 [IE] Ireland ..... 2339/87

[51] Int. Cl.[4] ..... E21B 4/14; E21B 10/38; E21B 10/60

[52] U.S. Cl. ..... 175/296; 175/215; 175/393; 175/418

[58] Field of Search ..... 175/339, 340, 393, 417, 175/418, 296, 297, 293, 215, 92; 173/73

[56] References Cited

U.S. PATENT DOCUMENTS

| | | | |
|---|---|---|---|
| 2,903,239 | 9/1959 | Standridge | 175/393 X |
| 3,416,618 | 12/1968 | Kunnemann | 175/339 |
| 3,419,092 | 12/1968 | Elenburg | 175/339 X |
| 3,524,511 | 8/1970 | Klemm | 175/296 X |
| 4,321,974 | 3/1982 | Klemm | 175/405 X |
| 4,705,119 | 11/1987 | Kostylev et al. | 175/296 X |
| 4,709,768 | 12/1987 | Kostylev et al. | 175/296 |

*Primary Examiner*—Stephen J. Novosad
*Attorney, Agent, or Firm*—Kenyon & Kenyon

[57] ABSTRACT

A reverse circulation down-the-hole hammer drill apparatus for drilling rock and overburden comprises a fluid-driven piston which reciprocates in an annular chamber to repeatedly strike a bit suspended at one end of the chamber, for example in a splined mounting. Fluid is exhausted through the bit directly to the face of the bit and cuttings and debris are returned via a central throughbore in the bit and in the drill apparatus to the surface. The bit drops forward on encountering a void during drilling operations to open by-pass passages which exhaust fluid directly into the throughbore temporarily so as to prevent any loss of return of sample to the surface.

33 Claims, 11 Drawing Sheets

REVERSE CIRCULATION DOWN-THE-HOLE HAMMER DRILL AND BIT THEREFOR

FIELD OF THE INVENTION

The present invention relates to an improved rock drill, in particular to an improved reverse circulation down-the-hole hammer drill actuated by a fluid such as compressed air, and to a bit therefor.

BACKGROUND OF THE INVENTION

Reverse circulation is a technique which offers may advantages over "normal" circulation when applied to rock drills comprising a surface rotary drill with double wall drill stem and a conventional tri-cone bit, and particularly when applied to work drills comprising a percussive tool suspended down the hole, herein referred to as down-the-hole (DTH) hammer drills. The main advantage is speed of penetration and removal of cuttings. In a reverse circulation system, rock cuttings and debris are forced up through a hollow passageway in the drill itself and the drill string to the surface from the bottom face of the hole by the action of recirculated drilling fluid under pressure. The drilling fluid, which may for example be compressed air, or air/water, or mud in the case of a rotary drill, is circulated down the annular space between the wall of the hole and the drill string, or alternatively down an annular space inside the drill string. It is more preferred to circulate fluid down an annular space in the drill string as this preserves the integrity of the hole wall. Another advantage of the reverse circulation technique is that rock formations are continuously sampled as drilling proceeds, and a representative sample can be collected and monitored at the surface as sample is returned quickly from the bottom of the hole.

Firstly, there are conventional reverse circulation rotary drills which use a tri-cone bit. These can return cuttings directly from the drill face resulting in a geological sample of reasonable purity (e.g. approximately 7–12% contamination). Sample contamination can occur by caving formations or by particles eroded from upper portions of the wall of the hole. Sample is returned after encountering a void so that there is little loss of sample in fractured formations. It is possible to drill about 700–1000 ft below the water table using a standard compressor. However, rotary drills suffer from slow rates of penetration when drilling through hard rock, the cost of the tri-cone bit is high and the bit life is short (e.g. typically about 200–1000 ft drilled).

Secondly, there are the known reverse circulation DTH hammer drills which include a crossover sub-connector spaced from the bit. Although operating costs are lower than in rotary drilling and penetration rates are higher in hard rock, the geological sample may be of questionable purity with contamination levels of about 10–20%. Significant contamination occurs during passage of the debris and cuttings between the face of the bit and the crossover sub-connector externally of the bit, before the debris enters the central bore where it is carried to the surface. Also, the return flow of air is affected by ground water in the hole and the drill tends to flood out at about 400–500 ft below the water table, unless a booster compressor is used. When a void is encountered, there is an interruption of the return of sample until such time as the crossover sub-connector has penetrated beyond the void and resealed in the hole—generally this results in the loss of about 6–8 ft of sample. In general, the known drills are prone to blockage in soft formations and overburden.

It has been proposed in U.S. Pat. No. 3,795,283 to exhaust fluid through peripheral bores of the bit and to return fluid and debris via a central throughbore in the bit and drill in a reverse circulation DTH drill also driven by a conventional surface rotary drilling table. However, this arrangement suffers from a number of disadvantages:

It is still basically a rotary drill.

The drill comprises a comparatively small piston which reciprocates in an annular chamber to repeatedly strike a longer, heavier, anvil to which a bit is secured. Thus, the piston does not directly strike the bit.

The bit employed is a conventional drifter chisel bit adapted for DTH drilling. Thus it is possible to some extent for fluid to exhaust at the bit face to the external periphery of the bit, as there is no effective seal with the sides of the hole, resulting in some loss of sample and loss of "lift" in the central throughbore.

A significant portion of the exhaust fluid is permanently diverted to the central throughbore in the bit to provide "lift" by means of a jet action. Blockage of the bit face exhaust outlets is thus more likely to occur.

At the bit face, the return or throughbore outlet is axially aligned as opposed to being off center. The outlet is thus more likely to block with large size cuttings and pieces of core which are not broken up.

The structure of the bit is inherently weak, there being sixteen bit face exhaust outlets in the peripheral region of the bit.

It is an object of present invention to provide a reverse circulation DTH hammer drill with improved efficiency and performance in both overburden and hard rock, as compared to prior art drills.

SUMMARY OF THE INVENTION

According to the present invention there is provided a bit for a reverse circulation down-the-hole drill, which defines a central return passageway, actuated by fluid under pressure adapted in use to be suspendably mountable in a chuck secured to the forward end of the drill, comprising:

a stem portion slidably mountable within the chuck, and adapted to extend into the drill, a body portion extending from the stem portion to terminate in a bit face adapted to support abrading means, main fluid exhaust means defined by a duct associated with the stem portion and passing through the body portion to a plurality of exhaust outlets defined in the bit face, a return outlet defined by the body portion and opening to the bit face, which is in fluid communication with the central return passageway in the drill, and restricting means defined by said body portion adapted to reduce the flow of exhausted fluid from the exhaust outlets to an annulus defined in use between a hole bore and the drill, whereby substantially all exhausted fluid is circulated from the exhaust outlets to the central return passageway via the return outlet in front of the face of the bit.

There is also provided a bit for a reverse circulation down-the-hole drill, which defines a central return passageway, actuated by fluid under pressure adapted in use to be suspendably mountable in a chuck secured to the forward end of the drill, comprising:

a stem portion slidably mountable within the chuck, and adapted to extend into the drill, a body portion extending from the stem portion to terminate in a bit face adapted to support abrading means, main fluid exhaust means defined by a duct associated with the stem portion and passing through the body portion to a plurality of exhaust outlets defined in the bit face, wherein at least one of the exhaust outlets is directed inwardly towards the center of the face of the bit, and a return outlet defined by the body portion and opening to the bit face which is in fluid communication through the bit with the central return passageway in the drill.

The present invention also provides a reverse circulation percussive drill apparatus adapted for down-the-hole drilling comprising:

an outer wear sleeve;

a backhead assembly located at one end of the outer wear sleeve for connecting the drill apparatus to a double-walled drill string and to a source of pressure fluid to actuate the drill;

a fluid diverter mounted inside the outer wear sleeve adjacent to the backhead;

an inner tube concentric with the outer wear sleeve and extending into the fluid diverter defining at least part of a central return passageway in the drill apparatus;

a bit located by a chuck mounting at the other end of the outer wear sleeve slidably mounted on the said inner tube in an annular chamber defined by the outer wear sleeve, by the inner tube, the diverter at one end, and the bit at the other end wherein the bit defines main fluid exhaust means communicating directly between the chamber and the face of the bit;

an inner sleeve mounted inside the outer wear sleeve towards said one end of the chamber adjacent to the diverter defining a fluid communication passage between the diverter and the chamber via porting means;

a piston slidably disposed in the said chamber with respect to the inner sleeve to cooperate with the porting means and mounted on the inner tube to reciprocate within the chamber so as to repeatedly deliver a blow to the bit.

Advantageously, the drill apparatus is additionally provided with by-pass means to exhaust fluid from the said other end of the chamber operable when the bit has fallen forward in the chuck beyond a pre-determined point of protraction thereby to arrest the piston temporarily until the bit has retracted, such that in the protracted condition substantially all the fluid which normally reciprocates the piston is re-routed directly to the main exhaust duct.

The drill of the present invention offers the following advantages:

1. It is capable of high penetration rates, even in hard rock.
2. Because drilling fluid is exhausted almost entirely to the face of the-bit and passes up through the central return passageway, this allows for a virtually contamination-free sample, since debris and cuttings are returned to the surface entirely inside the apparatus.
3. Because the exhaust and return openings are located in the face of the bit, drilling in a ground water-filled hole can proceed to much greater depths before the water pressure adversely affects the drill's performance. In fact, extra water pressure can actually assist the return of sample as there is no opposition between the return flow of sample and of water to the surface.
4. When exhaust openings communicate directly with the return openings at the bit face, and/or when the exhaust openings are inwardly-directed towards the return openings, the problem of mud-plugging when drilling in overburden or soft formations such as mud or clay is largely overcome.
5. The drill and bit may be adapted to cooperate to open return by-pass passageways when the bit drops forward on entering a void or cavity in the formation being drilled. The additional by-pass fluid flow serves to keep the debris and cuttings in suspension in the return tube, thus preventing fall back blockage and ensuring no loss of sample.
6. Because fluid and debris are not exhausted above the periphery of the drill bit, the periphery may be a substantially continuous surface thus effectively sealing the bottom hole cavity, or cutting down the ingress of ground water in the hole to the cavity. The tendency to flood out the drill is greatly reduced, and water gathering at the bottom of the hole can be flushed out more quickly than with conventional drills.

It is important that the drilling fluid is exhausted almost in its entirety into the bottom hole cavity from the forward end of the drill assembly, and thence up the return passageway in the drill, in such a manner as to ensure maximum lift to the cuttings and debris to be carried to the surface, to minimise contamination of sample and as far as possible to seal off the bottom hole cavity from the ingress of ground water in the hole.

DETAILED DESCRIPTION

Figure 1:
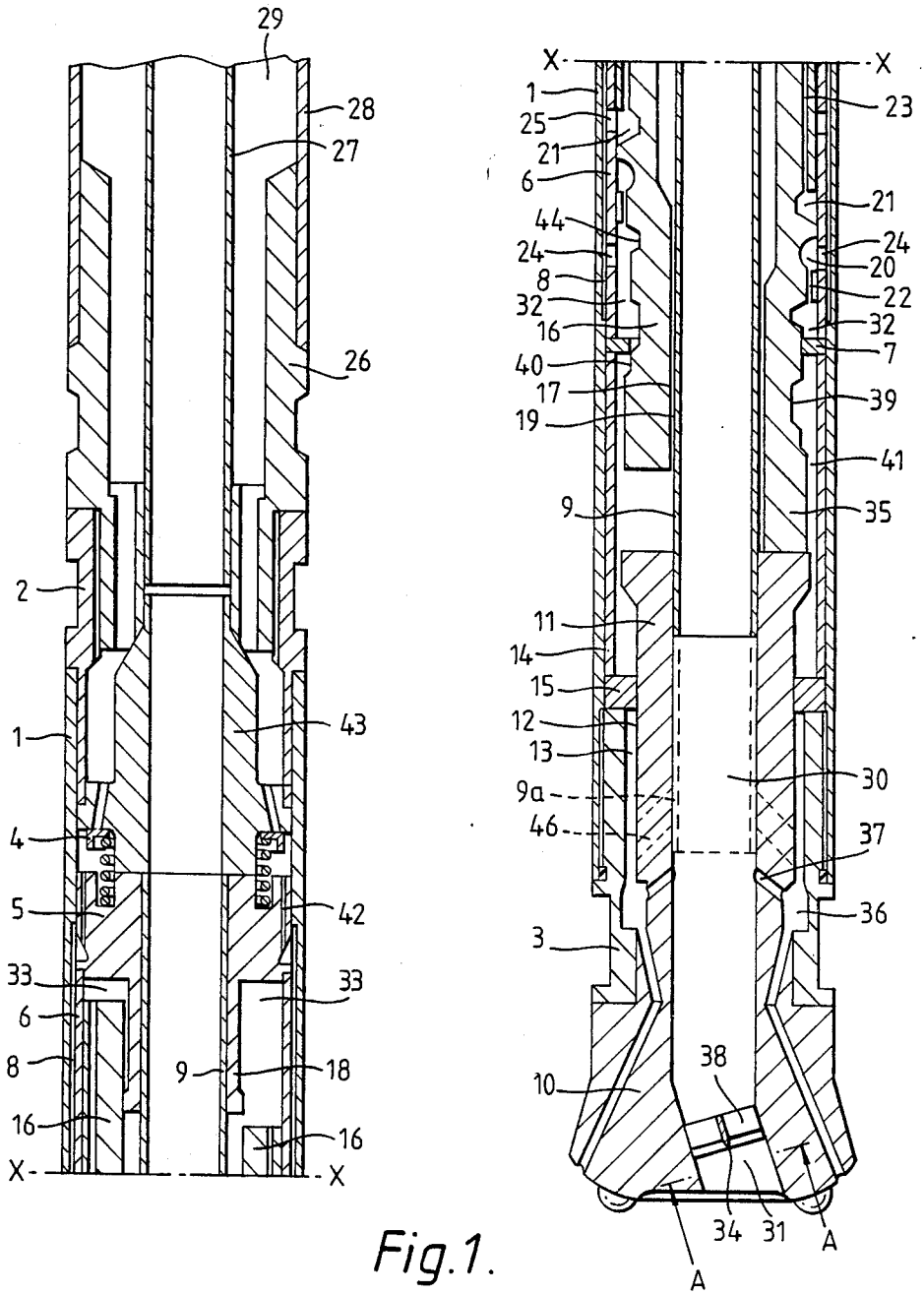
FIG. 1 is a sectional side elevation of a rock drill according to a firs of the invention.
Figure 2:
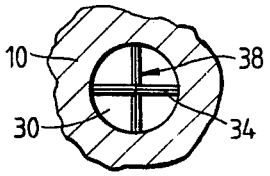
FIG. 2 is a partial cross-section on line A—A of FIG. 1.

Referring to FIGS. 1 and 2 of the drawings, a reverse circulation down-the-hole hammer drill driven by a supply of compressed air has an outer wear sleeve 1 secured at its rearward end to a backhead 2 and at the forward end to a chuck 3. Located within the wear sleeve at the rearward end is a check valve 4 in sealing engagement with the back head member 2. An inner cylinder 6 is mounted on the air diverter member 5, and extends to a split bearing 7 located within the wear sleeve at the forward end, the outer diameter of the wear sleeve being such as to provide an annular gap 8 between the wear sleeve and the cylinder 6.

The air diverter 5 has a central throughbore into which is fitted a center tube 9. The tube 9 extends forwardly into a corresponding central throughbore 30 in the rearwardly extending stem 11 of drill bit 10. An outer surface of the stem 11 of the drill bit and the opposing inner surface of the chuck 3 are splined, the splines 12 being so dimensioned as to provide a number of fluid passageways 13 around the drill bit 10. Lying within the wear sleeve 1 between the chuck 3 and the bearing 7 is a solid/split ring spacer 14 on which is provided a bit retainer 15. Partially within the cylinder 6 and surrounding the center tube 9 is a piston 16 having at its forward ed an enlarged diameter striking head or "clubhead" 35 and a slightly enlarged bore 17 for sliding engagement over tube 9 leaving an annular gap 19. At the rearward end of the piston the bore is enlarged for sliding engagement over a stem portion 18 of the air diverter 5. The piston 16 has two grooves 20, 21 from which, respectively, extend fluid passageways 22, 23. The inlet grooves 20, 21 respectively co-operate in turn with ports 24, 25 in the wall of the cylinder 6. At the rearward end, a dual pipe joint 26 is provided, locating a center tube 27 co-axially with a bore through a connector 43. Incoming pressure air passes through annular fluid passageway 29 between center tube 27 and outer tube 28, past connector 43 and check valve 4 leading to the diverter 5.

At the commencement of operations with the piston 16 at its position of rest (as illustrated in the right-hand section of FIG. 1) at the beginning of the up or return stroke of the piston the instant the piston leaves the striking end of the drill bit, a chamber 33 defined by the diverter 5, the top of the piston 16, and the inner cylinder 6, communicates directly with the passageways 13 via annular gap 19 around the drill bit to exhaust any pressure air. Thus, with the piston 16 at its position of rest the piston head 35 extends past the bearing 7 and is in contact with the striking end of the drill bit 10. Here, a groove 44 in the piston 16, the bearing 7 and the cylinder 6 define a chamber 32 into which the passageway 22 in the piston emerges, and the groove 20 in the piston is in register with the port 24 through the wall of the cylinder 6. On the admission of pressure air through the annular passageway 29, air passes through the check valve 4 and air diverter 5 via passageway 42 into the annular gap 8, from where it passes through the ports 20, 24 and down the passageway 22 to pressurize the chamber 32 and apply an upward force on the piston.

As the piston returns to the rear, groove 20 is no longer in register with port 24 and so live air is cut off from chamber 32. The trapped air in chamber 32 now expands and exerts a continuing upward force on the piston 16. When groove 39 in the piston clears the bearing 7 the expanding air in chamber 32 is released past the annular space 41 around the piston 35 to the passageways 13.

At the backhead end the diverter stem 18 has entered the piston creating a chamber 33 formed by the piston 16, the diverter 5, the cylinder 6 and the diverter stem 18. When groove 21 of the piston comes into register with port 25 of the inner cylinder 6, pressure air is supplied to chamber 33 via the passageway 23 in the piston. This air causes a downward force on the back face of the piston and arrests its rearward motion. When the groove 21 has passed port 25 in the cylinder live air is cut off from chamber 33. The piston comes to a stop as shoulder 40 on the piston impinges on bearing 7 (see left-hand section of FIG. 1) but because of the continued pressure in chamber 33 it accelerates forward again. The trapped air expands and exerts a continuing force on the back of the piston until the stem 18 of the diverter is clear of the piston bore at which time the pressure air may exhaust through annular gap 19 and passageways 13 into chamber 36 as previously described.

Once the groove 20 comes into register with port 24 and air is admitted through passageway 22 the chamber 32 which is formed when the groove 39 has passed the bearing 7, so commencing the next return stroke.

Thus, for so long as pressure air is provided the piston is caused to reciprocate at high speed, with pressure air in the chambers 32 and 33 being alternately exhausted through the passageways 13 around the exterior of the drill bit. Consequently, all of the exhausted air passes to an expansion chamber 36 defined by the chuck 3 and drill bit 10, and thence to the periphery of the bit. A portion of the exhausted air is directed to venturi orifices 37 in the bit 10 communicating with the central throughbore 30 while the remainder is exhausted into the bottom cavity of the hole being drilled. The air exhausted to the bottom cavity of the hole escapes through angled passageway 31 in the central bore of the bit, and through a bit gate 38 (see FIG. 2 also) and up through the center of the drill assembly, carrying with it cuttings and debris congregating in the bottom cavity of the hole. The gate 38 as illustrated comprises a cruciform arrangement of two knife edges 34, the sharp edges being directed towards the opening of the angled passageway 31. A series of interchangeable gates may be provided having from one to twelve knife edges selected to break up differing grades of mud or soft rock debris. The gate 38 also prevents oversize rock particles from being blown up the throughbore before being broken into smaller particles. However, the fact that passageway 31 is angled or off center, is important in preventing blockage by oversize particles and pieces of core, and the bit gate is only helpful in softer formations.

Figure 3:
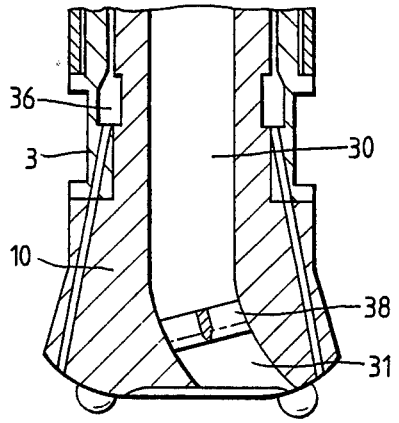
FIG. 3 is a sectional side elevation of a modified drill bit portion of the arrangement shown in FIG. 1.

FIG. 3 shows a modified arrangement of the drill bit 10 and chuck 3, wherein the ducts directing exhausted air from the expansion chamber 36 are disposed in straight lines as opposed to the angled ducts shown in FIG. 1. In this embodiment, ducts are formed in the chuck 3 and aligned with corresponding ducts in the bit 10.

Figure 4:
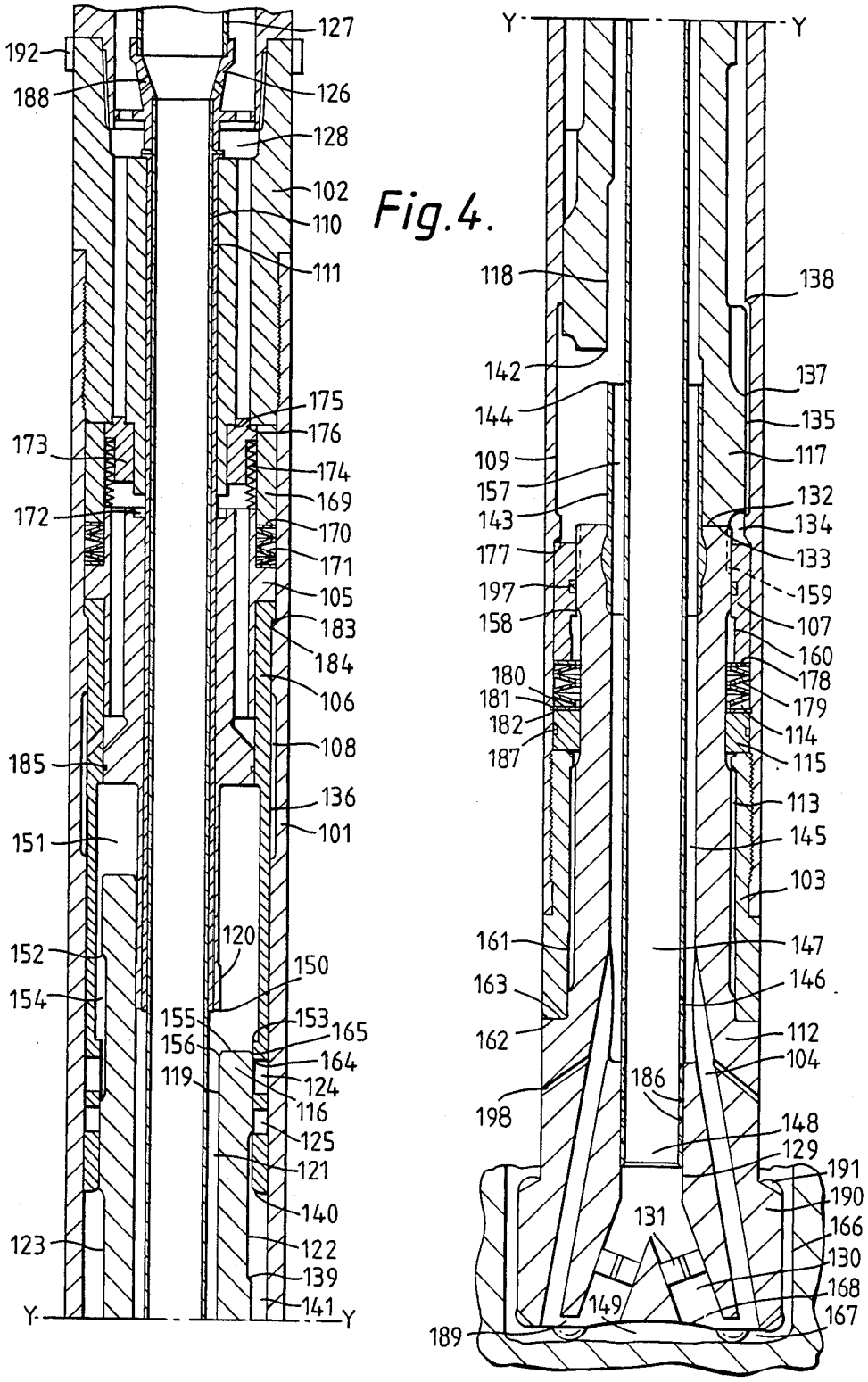
FIG. 4 is a longitudinal section of a rock drill according to a second embodiment of the invention.

Another modification is shown with reference to FIG. 1. If tube 9 is extended, as shown by dashed lines (*9a*) and auxiliary venturi orifices 46 are provided rearwardly of orifices 37, the orifices 46 will be exposed to the throughbore 30 when the bit is fully protracted, i.e. drops forward, on encountering a void. Thus, more exhausted air is by-passed to the throughbore to give a temporary extra "lift" to debris suspended in the throughbore, in order to avoid loss of sample. As soon as the face of the bit hits the bottom of the void and retracts to the position illustrated, normal cycling of the piston can recommenced A second embodiment of the invention will now be described with reference to FIG. 4 which shows a reverse circulation down-the-hole hammer drill having an outer wear sleeve 101 secured at one end to a backhead 102 and at the opposite end to a chuck 103. Located within the wear sleeve 101 at the end towards the backhead 102 is a check valve assembly in sealing engagement with the backhead 102. The check valve assembly comprises check valve 173, check valve spring 174, seal 175 and seal 176. Interposed between the backhead 102 and a diverter 105 are a spacer 169, a wear spacer 170 and a set of disc springs 171 which act as a shock absorber. A seal 172 between the inner abutting surfaces of the backhead 102 and the diverter 105 are so designed to compensate for wear and to seal the pressure fluid from passing directly through the bore of the diverter 105. An inner cylinder 106 is mounted on the air diverter 105 and extends into the wear sleeve 101. The inner cylinder 106 is located in the wear sleeve 101 by a shoulder 183 of the inner cylinder contacting a shoulder 184 in the wear sleeve 101. A bearing 107 is located within the wear sleeve 101 at the end towards the chuck 103, and is held in position by a shoulder 177 in the wear sleeve, compression washer 178, disc springs 179, washer 180, and retaining washer 181 located in a wear sleeve groove 182. Interposed between the chuck 103 and the retaining washer 181 is a bit retaining ring 115. The inner diameter of the wear sleeve is enlarged in two places so as to provide annular gaps 108 and 109. The air diverter 105 has a through bore in which is fitted a center tube 110, and a fitting or spacer tube 111, which is optional. A drill bit 112 is mounted on the opposite end of the wear sleeve through the bearing 107 and is held in place by the bit retaining ring 115. The outer surface of the drill bit and the inner surface of the chuck are correspondingly splined as indicated at 113, the splines being so dimensioned as to provide a number of fluid passageways 113 around the drill bit 112. Partially within the cylinder 106 and surrounding the center tube 109 is a piston 116 having an enlarged striking head 117 with an enlarged bore 118 on one end and an enlarged bore 119 for sliding engagement over a stem 120 on the air diverter 105 at the other end. There is an annular gap 121 between the throughbore of the piston 116 and the center tube 110.

The piston 116 has two grooves 122, 123 which form respectively, fluid passageways 154, 141. The grooves 122, 123, respectively co-operate with ports 124, 125 through the wall of the cylinder 106. At the back-head end, a dual pipe joint 126 is provided, locating the tubes 110, 111 co-axially with a bore through the backhead 102 and diverter 105 leading to an outer tube 127 to provide an annular fluid passageway 128 for incoming pressure fluid. The drill bit 112 has a center bore 129 extending beyond the end of the center tube 110. At its forward end, the drill bit 112 is provided with one or more angled return passageways 130. Two such passageways are illustrated. In this passageway a bit gate 131 may be used to fragment mud debris but in hard rock, this is superfluous. The drill bit is also provided with angled exhaust passageways 104 communicating between a central annular duct 145 and the outer periphery of the bit head.

The face of the bit head and the walls of the bottom hole cavity define a "drilling space" 149 in front of the bit head during the drilling of a hole. If this space becomes blocked by dense or sticky material such bentonite clay, communication between exhaust passageways 104 and return passageways 130 remains open via recessed channels 189 at the bit face.

At the commencement of operations, and with the piston 116 at its position of rest (as illustrated in the right-hand section of FIG. 4). the piston striking face 132 is in contact with the contact face 133 of the drill bit 112. Here, the piston 116, the bearing 107, the bit 112, the footvalve 143, and the wear sleeve 101 define a chamber 134 into which a passageway 135 in the piston 116 emerges, and the groove 122 in the piston is in register with port 125 through the cylinder wall.

On the admission of pressure fluid through the annular passageway 128, fluid passes through the check valve 173 and air diverter 105 into the annular gap 108, through groove 136 from where it passes through the port 125 and, down the groove 122 and groove 135 to pressurise the chamber 134 and apply a rearward force on the piston and which accelerates the piston rearwardly. The rearward movement continues with live pressurized fluid in chamber 134 acting on the surface 132 of the piston 116. When the edge 137 of groove 135 coincides with edge 138 of the wear sleeve groove 109 the flow of pressurized fluid to chamber 134 ceases. The piston 116 will continue to move rearwardly due to the expanding pressure fluid remaining in chamber 134. When the forward edge 139 of the piston groove 122 reaches the rearmost edge 140 of the inner cylinder 106, live fluid is cut off from chamber 141 formed by piston 116 inner cylinder 106 and wear sleeve 101. As the piston 116 continues its rearward movement the pressure fluid in chamber 141 is further compressed and acts as a compression spring in the forward direction.

Midway through the cycle, when the front edge 142 of the piston bore 118 passes the rearmost edge 144 of footvalve 143 the pressurised fluid in chamber 134 may now exhaust through annular passageway 157 leading to passageway 145 of the bit 112, and then through drilled holes 104 of the bit 112. A portion of the fluid will exhaust through angled holes 146 into bore 147 of the return tube 110. This air flow will cause a venturi effect and create a suction force in area 148. The main portion of the exhaust fluid passes through passageway 145 of the bit 112 and enters drilling space 149 which is a space bounded by the walls 166 of the material 167 to be drilled, and the concave face 168 of the bit 112. The fluid is turbulently flushed from space 149 through the return orifices 130 and bit gates 131 into the suction area 148 thence to area 147 through the internal bore of tube 110 into the bore of tube 127 and thence to the surface collection apparatus. Meanwhile the front end 150 of the diverter stem 120 has entered into bore 119 of the piston 116 sealing chamber 151 defined by the piston 116, inner cylinder 106, diverter 105 and diverter stem 120. When the rearward edge 152 of the groove 122 of piston 116 reaches a point 153 on the inner cylinder 106 live fluid passes from port 124 through passage 154 formed between piston groove 122 and inner cylinder 106 and enters into chamber 151. This pressurised fluid applies a forward force on surface 155 of the piston 116 and arrests the rearward movement of the piston. At this stage the piston has reached the position illustrated in the left-hand section of FIG. 4.

When the piston comes to a stop the force continues to act and drives the piston in the forward direction until point 152 on the piston 116 coincides with point 153 on the inner cylinder, at which point live pressure fluid is cut off from chamber 151. The trapped fluid in chamber 151 continues to expand and to drive the piston forward until point 150 on the diverter stem 120 is clear of point 156 of the piston bore 119, at which time the pressurised fluid is released and exhausts through the annular passageway 121 between the piston 116 and tube 110. The exhausting fluid passes into annular groove 157 which has already been sealed by the piston bore 118 covering the foot valve 143. The exhausted fluid then passes through the bit as previously described. The piston continues to move forward and when point 137 of the piston groove coincides with point 138 of the wear sleeve groove pressure fluid is admitted to chamber 134 and puts a rearward force on to piston surface 132. This force is not sufficient to stop the piston which strikes the bit driving the bit forward. As the piston is stopped it is acted upon by the force in chamber 34 and by the recoil from the impact with the bit and so moves rearwardly again to commence another cycle.

Reciprocating movement of the piston continues as long as pressurized fluid is supplied through the drill stem and the bit is held within the hammer by the action of the external force supplied through the drill stem. When the forward feed on the drill stem is stopped, reversed or when the bit breaks into a cavity or fissure then the drill bit 116 will move forward in the chuck until the bit retaining ring 115 contacts shoulder 158 of the drill bit, at which point forward movement of the bit is arrested. The piston can now travel forward compressing the fluid in chamber 134 which causes an increasing deceleration force on the piston. When flats 159 on the bit pass the grooves 160 in the bearing 107 the pressurized fluid in chamber 134 is released through the passageways formed by the splines 113 of the bit and the internal splines 161 on the chuck, and the gap that will have opened between surfaces 163 on the chuck and shoulder 162 on the bit 112. The release of pressure from chamber 134 is necessary to prevent the pressure fluid from accelerating the piston in the upward direction and so starting another cycle.

The piston may thus be described as going temporarily "on blow". At this time, point 164 on the piston rear face has cleared point 165 on the port 124 in the inner cylinder 106 and the pressure fluid is able to escape through the annular passageway 121 in the piston, and through the annular passageway 145 in the bit. Because the bit has now protracted fully forward the inclined holes 186 in the return tube 110 are now in communication with passageway 145 and a very much increased direct exhaust or blow effect is achieved which serves to clear out any debris still in the exhaust tube and to prevent the debris from falling forward out of the exhaust tube as tends to happen in conventional reverse circulation systems in these circumstances. Holes 188 may be drilled in the dual pipe joint 126 to permanently exhaust pressure fluid at an angle up into tube 127 at the backhead, thus further reducing the possibility of "fall forward" blockage. The holes 188 also serve to relieve excess fluid pressure but a choke 193 may optionally be used for this purpose.

It has been found that the performance of the drill can be significantly increased by providing a fluid seal 197, such as a flexible air seal of rubber, nylon, brass, etc., at an appropriate point across the gap between the bit 112 and the bearing 107, which gap is normally only sufficient to allow clearance for a sliding fit. It will be appreciated that even such a gap is susceptible to allowing pressure air to leak past the bit at the commencement of the return stroke, which in turn will result in a loss of blow energy on the down stroke, particularly at higher working pressure. However, if such a seal is provided, it is desirable to provide a fluid pressure relief exhaust duct 198, which communicates between angled exhaust passageways 104 and the exterior of the bit.

Figure 5:
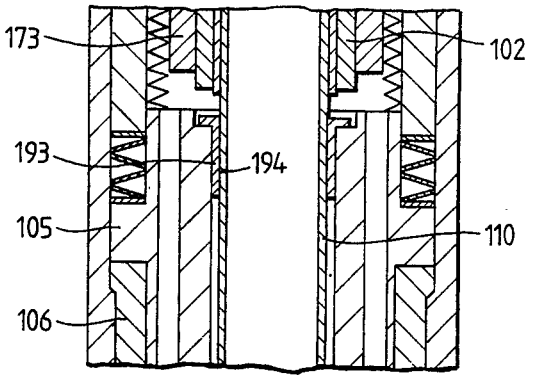
FIG. 5 is a detail longitudinal cross-section of a rock drill as shown in FIG. 4, including a choke arrangement.

FIG. 5 illustrates a choke 193 which serves to provide a controlled annular gap between the inner tube 110 and the diverter 105 to allow a controlled amount of air to bypass the working areas of the hammer. The purpose of this bypass flow of air is (a) to reduce the air pressure at the compressor, and/or (b) to increase the flow of air through the return tube. The controlled gap 194 is defined between the choke bore and the inner tube 110 (or spacer tube 111, if present).

Figure 6:
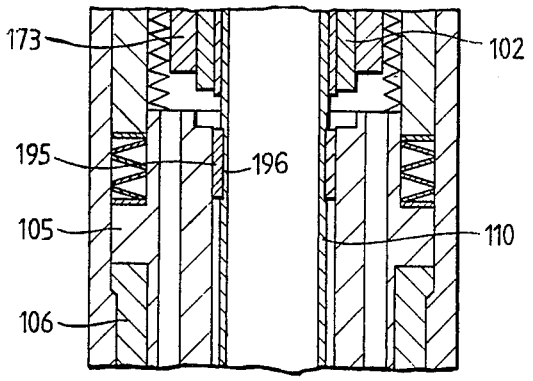
FIG. 6 is a detail longitudinal cross-section of a rock drill as shown in FIG. 4, including an alternative choke arrangement.

FIG. 6 illustrates an alternative choke 195 which defines a controlled annular gap 196 between the outer diameter of the choke and the bore of the diverter 105.

Alternatively, the function of the choke may be accomplished by appropriately varying the diameter of a spacer tube 111, or of the inner tube 110, if necessary by providing a shoulder.

An enlarged bit head 190 may be provided with conventional up-turned carbide insert buttons 191 located on the trailing edge of the bit head. This increases the annular space surrounding the drill when it is suspended in a hole and makes the drill easier to withdraw from the hole. Cave-ins are dislodged and broken up by cutter vanes 192 higher up the drill and by buttons 191 in a manner know per se.

The design and construction of the drill bit forms the most important aspect of the present invention, especially the configuration of exhaust and return outlets and the structure of the face of the bit. These features may be adapted in many ways to suit particular types of formations being drilled, and will be described in further detail with reference to FIGS. 7 to 21.

Figure 7:
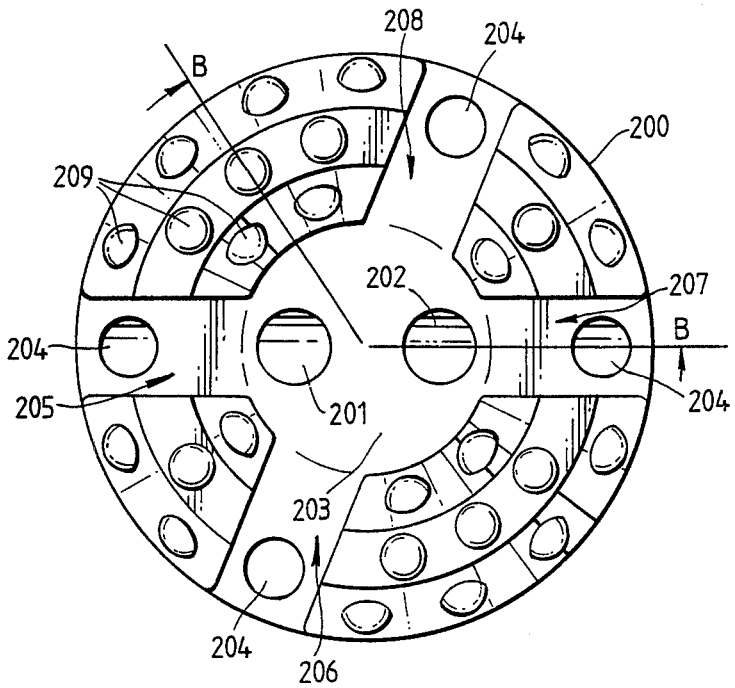
FIG. 7 is a plan view from below of a drill bit according to a third embodiment of the invention.
Figure 8:
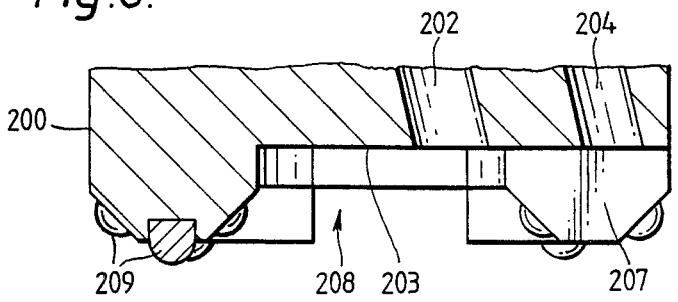
FIG. 8 is a cross-section viewed on section line B—B of FIG. 7.

FIGS. 7 and 8 show a bit 200 suitable for use in soft terrain. Similar to the return passages 130 in FIG. 4, the bit 200 has twin angled return passages 201, 202, opening to a "drop center" recess 203 in the face of the bit. Four exhaust passages 204 (corresponding to exhaust passages 104 in FIG. 4) open to the outer peripheral region of the face of the bit. Recesses 205, 206, 207, 208 disposed radially of the drop center 203 in an "X" allow direct communication between the exhaust openings and the return openings even when the face of the bit is in contact with the bottom of the hole. This design is adapted to clear and break up compacted mud which can easily clog at the face of the bit. Water may be injected into the compressed air to assist this process and turn the mud into a slurry which is more easily returned to the surface. Conventional carbide insert buttons 209 are disposed in a ring about the peripheral region of the bit face.

Figure 9:
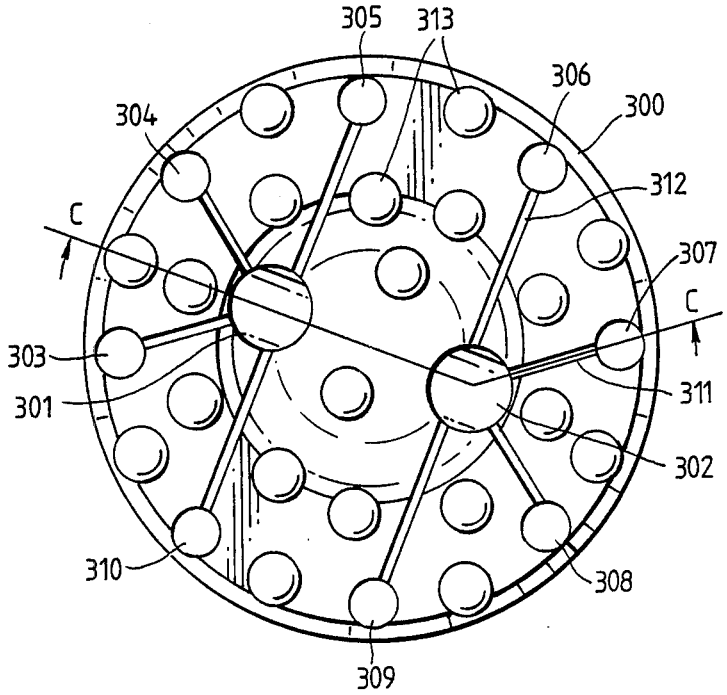
FIG. 9 is a plan view from below of a drill bit according to a fourth embodiment of the invention.
Figure 10:
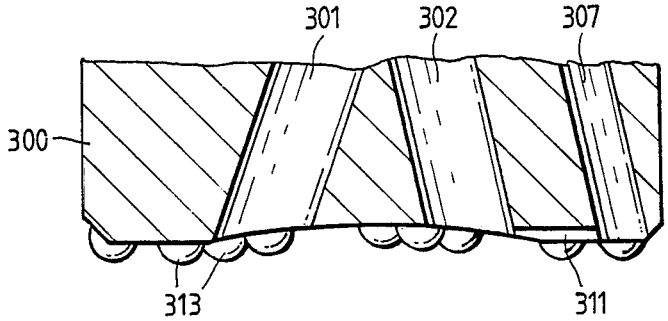
FIG. 10 is a cross-section viewed on section line C—C of FIG. 9.

FIGS. 9 and 10 show a bit 300 suitable for use as a hard rock bit. Twin return passages 301, 302 and eight exhaust passages 303–310 open to the face of the bit, and narrow recessed channels 311 and 312 connect the return and exhaust passages to allow for enhanced reverse circulation even at the instant when the bit face is in direct contact with the bottom of the hole. Buttons 313 are disposed across the whole bit face surface.

Figure 11:
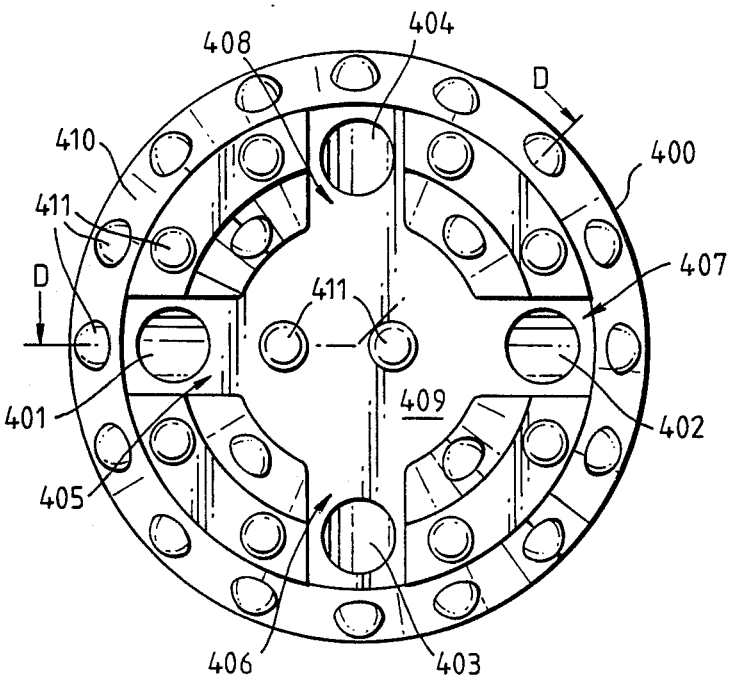
FIG. 11 is a plan view from below of a drill bit according to a fifth embodiment of the invention.
Figure 12:
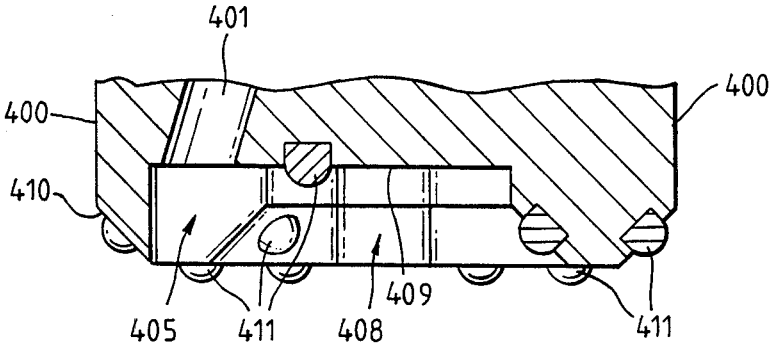
FIG. 12 is a cross-section viewed on section line D—D of FIG. 11.

FIGS. 11 and 12 show a bit 400 suitable for use in soft terrain. Twin return passages 401, 402 and twin exhaust passages 403, 404 open to the face of the bit. The return passages 401, 402 are more angled, and open nearer to the periphery of the bit face, and the exhaust passages 403, 404 are of similar diameter to the return passages. Recesses 405, 406, 407, 408 in the face of the bit allow for intercommunication between the exhaust and return openings and with an enclosed "drop center" recess 409, but recesses 405–408 do not extend all the way to the outer periphery 410 of the bit face. Buttons 411 are disposed in a ring about the peripheral region of the bit face, and also in the enclosed drop center recess 409. This design is particularly suited to drilling in clay or mud and the larger diameter twin exhaust openings tend to reduce blockage and mud plugging.

Figure 13:
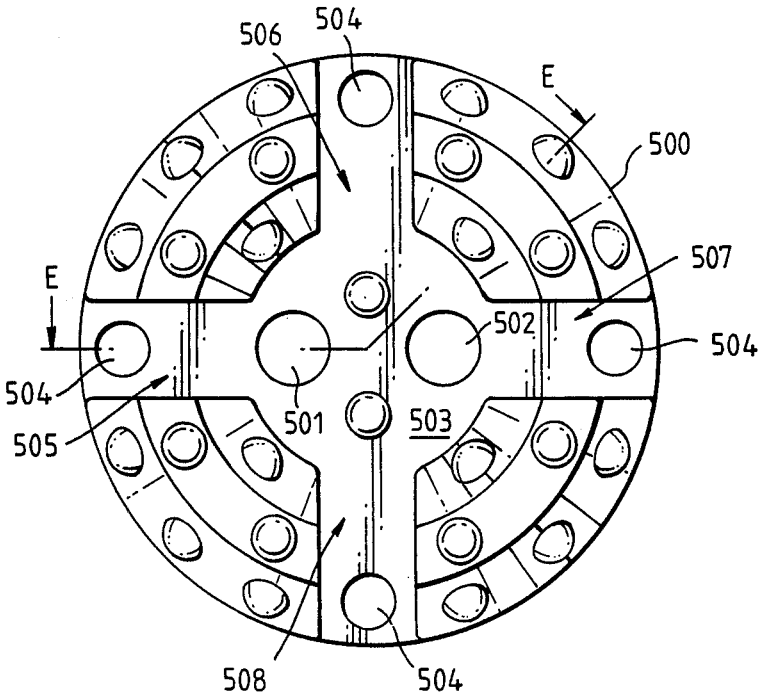
FIG. 13 is a plan view from below of a drill bit according to a sixth embodiment of the invention.
Figure 14:
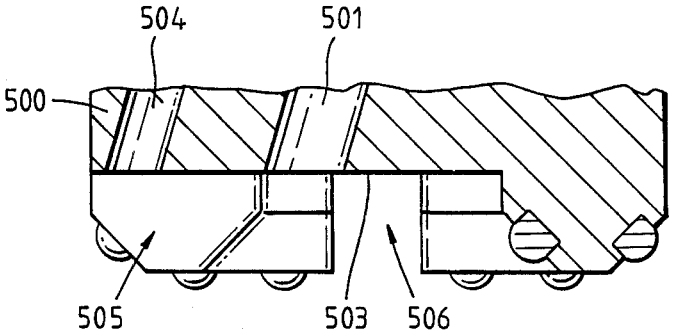
FIG. 14 is a cross-section viewed on section line E—E of FIG. 13.

FIGS. 13 and 14 show a bit 500 similar to that shown in FIGS. 7 and 8 suitable for use in soft terrain, having two return openings 501, 502 in a "drop center" recess 503, and four exhaust openings 504 situated in recesses 505–508 which form a cross on the face of the bit.

Figure 15:
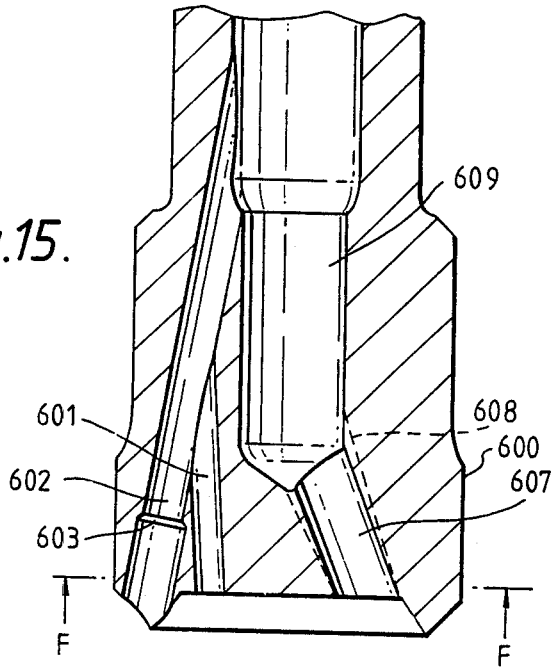
FIG. 15 is a partial longitudinal cross-section viewed on section G—G of FIG. 16 of a drill bit having two modified exhaust outlets, according to a seventh embodiment of the invention.
Figure 16:
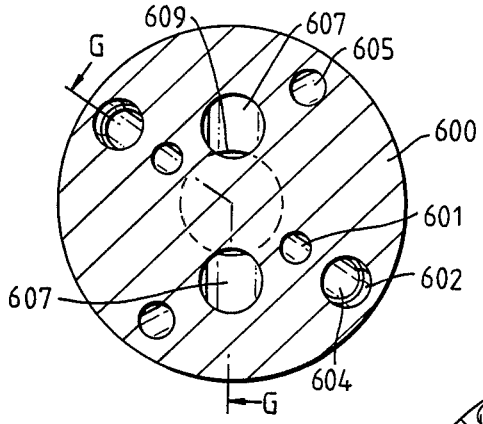
FIG. 16 is a cross-section viewed on section line F—F of FIG. 15.
Figure 17:
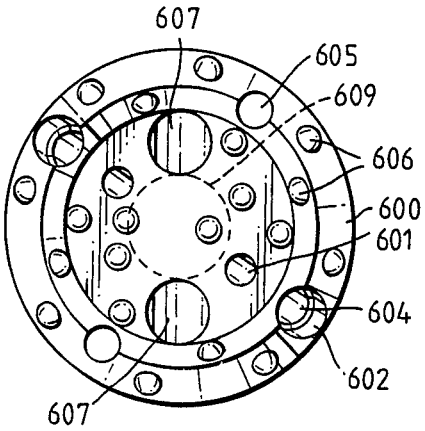
FIG. 17 is a plan view from below of the bit shown in FIGS. 15 and 16.

FIGS. 15 to 17 show a bit 600 suitable for drilling through dense mud or clay horizons. Drilling holes through mud or clay, especially when the strata are thick and waterlogged, can cause extreme difficulty with a percussion drilling tool due to the tendency of the mud or clay to plug the exhaust or return apertures. In conventional hammers, one method used to overcome this problem is to inject water into the compressed air, i.e. to use an air/water mixture as the drilling fluid. The water mixes with the mud or clay to form a sludge which can more readily be returned to the surface. In the reverse circulation drill bits described above, the technique of water injection would not be completely effective as the exhaust openings would tend to direct the air/water mixture away from the center of the bit so that the sludge would not be created directly in front of the bit in the region of the return outlets. To overcome this tendency, it is proposed to deflect one or more of the exhaust openings towards the center line of the bit. FIG. 15 illustrates how this may be achieved by drilling an alternative exhaust outlet 601 inclined inwardly of existing opening 602 and intersecting it above a reamed portion which provides a shoulder 603. The opening 602 is then plugged at the face of the bit by using a suitable plug and/or by welding. Most preferably, the plug is provided by a drill button 604 located against shoulder 603. FIGS. 16 and 17 show how two of the original exhaust openings (605) have been modified in this manner. The plugging buttons 604 are of a larger size than buttons 606, and may be domed or chisel-edged so as to provide additional abrasive capacity. It can be seen how the exhausted air/water mixture is deflected at the exhaust openings 601 towards the center line of the bit and towards return openings 607.

In an advantageous modification of the arrangement shown in FIG. 15, the return outlet 607 is tapered as indicated by dashed line 608, such that the diameter of outlet 608 where it communicates with the return passageway 609 is slightly greater than the diameter where it opens to the bit face. Thus any piece of debris or plug of mud which might otherwise lodge in the return outlet, or which falls back from passageway 609 into the outlet, may easily be dislodged again.

Figure 18:
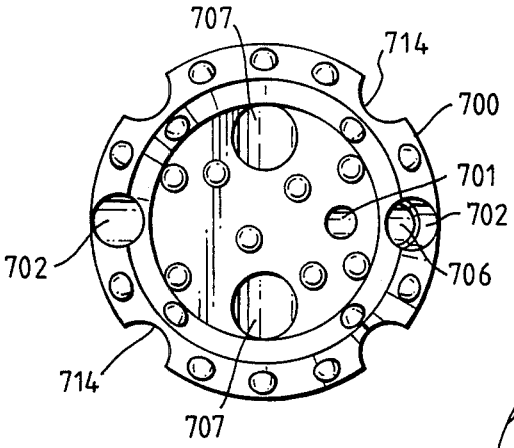
FIG. 18 is a plan view from below of a drill bit having one modified exhaust outlet, according to an eighth embodiment of the invention.
Figure 19:
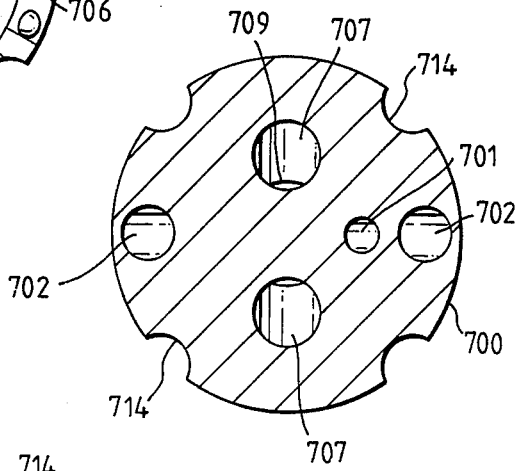
FIG. 19 is a cross-section, viewed similarly to that of FIG. 16, of the bit shown in FIG. 18.

FIGS. 18 and 19 show another arrangement in which only one exhaust outlet 702 has been plugged by button 706 and modified by providing an inclined outlet 701.

Figure 20:
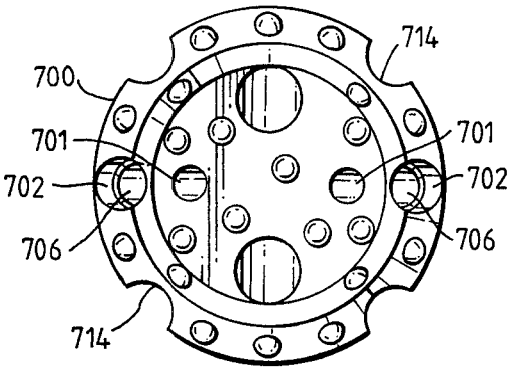
FIG. 20 is a plan view from below of a drill bit having two modified exhaust outlets, according to a ninth embodiment of the invention.
Figure 21:
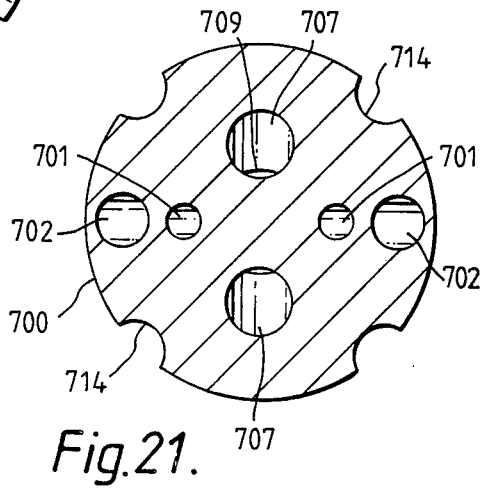
FIG. 21 is a cross-section viewed similarly to that of FIG. 16, of the bit shown in FIG. 20.

FIGS. 20 and 21 show the same arrangement in which both exhaust outlets 702 have been modified. Other methods could be employed, for example, a hole could be drilled from the inside partially to the front and drilling an intersecting hole from the front. Another method would be to drill a hole from the periphery of the bit towards the center, to drill an intersecting hole from the face of the bit to the first drilled hole, and where the first hole breaks the periphery could be plugged, welded or sleeved.

FIGS. 18 and 19, and 20 and 21, also illustrate longitudinal grooves 714 in the enlarged peripheral region of the bit 700 which serve to allow exhaust air and debris to bypass the central return passageway 709 and to enter the annular space between the drill string and the borehole. This bypass air flow may be desired for two reasons. Firstly, when drilling it serves to relieve a buildup of pneumatic pressure on the face of the bit. Secondly, the grooves 714 also have a beneficial effect when the hammer goes "on blow", as it enables the debris which has fallen down behind the bit to be returned to the surface via the annular space between the drill string and the borehole, i.e. via "normal circulation".

Figure 22:
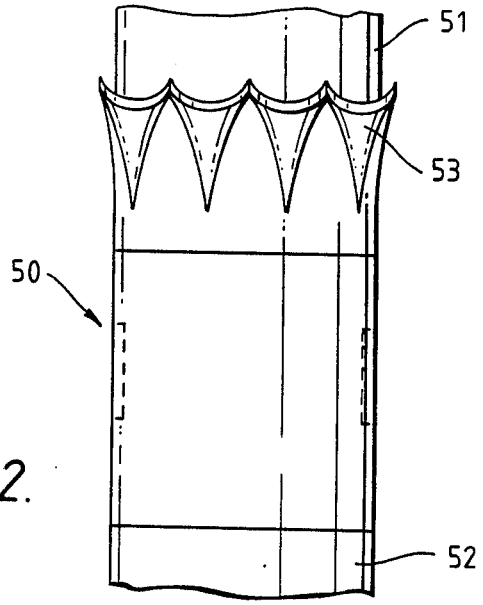
FIG. 22 is a side elevation of a retro reamer for use with the drill according to the invention.

FIG. 22 illustrates a retro reamer 50 which may be fitted at the juncture of dual pipe section 51 and backhead section 52. The reamer comprises a rearwardly-directed fluted cutter 53, which may be rotated to ream the hole when pulling the drill string assembly in a manner known per se, or to ream out of a collapsed or Jammed hole.

Figure 23:
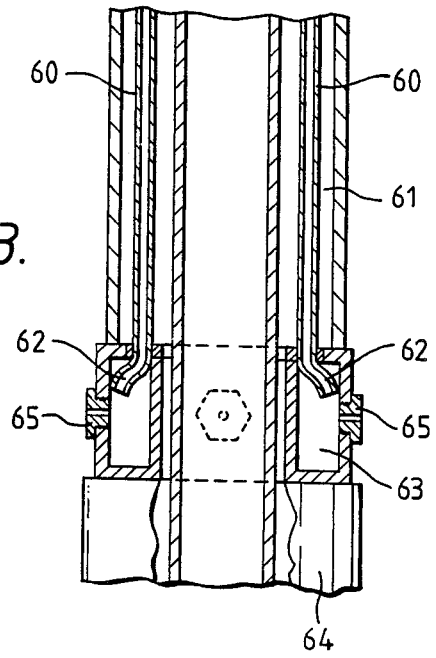
FIG. 23 is a longitudinal section of fluid cement injection system for use with a drill according to the invention.

FIG. 23 shows a fluid cement injection system which may be incorporated in a reverse circulation hammer drill. Four pipes 60 run down an annular pressure fluid inlet passageway 61 (corresponding to passageway 29 in FIG. 1) from the surface rig, adapted to convey fluid cement under pressure to angled outlets 62 inside a sealed cement reservoir 63 fitted to the backhead assembly 64. Four shotcrete nozzle jets 65 direct the fluid cement at the hole wall during cementing operations performed in a manner known per se, to prevent cave-ins, for example.

Conventional coring techniques may be used with a reverse circulation hammer drill according to the invention, whereby the initial drilling commences with the hammer drill to the depth at which conventional cores are required. The drill string is then pulled up and the bit is removed and replaced by a reamer bit (or corer) with a bore sufficient to allow a standard rock core to pass through. The string may then be fed to the bottom hole and the stems disconnected at ground level. Diamond coring may then be commenced using the rig's rotation and downfeed drive mechanism and cores retrieved by snatching. An alternative method of retrieving a solid core would be to have the bit designed with a central bore into which a core tube extending back inside the central stem tube should be fitted. Normal rotary drilling would result in a solid core within the core tube. When a sufficient depth were drilled the string would be pulled and the core tube removed and the core recovered.

RESULTS OF TESTS

Comparative tests have shown that a drill in accordance with the present invention can offer considerable practical advantages over a conventional reverse circulation DTH hammer drill fitted with a bit exhausting to the periphery and a crossover sub-connector, in which the two drills were set up to drill adjacent holes in the same terrain.

Compressors delivered about 750 cubic feet per minute of air at about 250 p.s.i to the drills. The conventional drill flooded out at about 700 ft and was pulling approximately 70 gallons of water per minute, in spite of increased pressure loading using a booster compressor. The drill of the present invention was still performing well without a booster compressor at 800 ft and was pulling only 20 gallons of water per minute. For technical reasons the hole was finished at that depth but indications were that a depth of 2000 ft could have been penetrated using a booster compressor. A choke had to be fitted to the drill to relieve excess pressure buildup so as to avoid periodical blowing of the compressor relief valve. Site geologists reported no visible contamination of sample returned by the drill, as compared to 10–20% contamination levels present in sample returned by the conventional drill. In formations with very thin mineralized horizons, e.g. placer gold deposits, such levels of contamination would be unacceptable. Testing also indicated that the drill could flush out the hole in about 5 minutes, as compared to 15 minutes for the same operation with the conventional drill.

What we claim is:

1. A bit for a reverse circulation down-the-hole drill, which defines a central return passageway, actuated by fluid under pressure adapted in use to be suspendably mountable in a chuck secured to the forward end of the drill, comprising:

a stem portion slidably mountable within the chuck, and adapted to extend into the drill, a body portion extending from the stem portion to terminate in a bit face adapted to support abrading means, main fluid exhaust means comprising a duct defined by an outer surface of the stem portion and passing through the body portion to communicate with a plurality of exhaust outlets defined in the bit face whereby substantially all exhausted fluid is conveyed through the body portion to the bit face; and a return outlet defined by the body portion and opening to the bit face, which is in fluid communication through the bit with the central return passageway in the drill.

2. A bit as recited in claim 1, comprising restricting means defined by a peripheral part of the body portion adapted to reduce the flow of exhausted fluid from the exhaust outlets to an annulus defined in use between a hole bore and the drill, whereby a substantial proportion of all the exhausted fluid is circulated from the exhaust outlets to the central return passageway via the return outlet, in front of the face of the bit.

3. A bit as recited in claim 1 wherein said duct is defined in use by spaces between external splines on the bit stem and internal splines on the chuck.

4. A bit as recited in claim 1 wherein the rearmost end of the stem portion is adapted for percussive contact with a clubhead piston.

5. A bit for a reverse circulation down-the-hole drill, which defines a central return passageway, actuated by fluid under pressure adapted in use to be suspendably mountable in a chuck secured to the forward end of the drill, comprising:

a stem portion slidably mountable within the chuck, and adapted to extend into the drill, a body portion extending from the stem portion to terminate in a bit face adapted to support abrading means, main fluid exhaust means defined by a duct associated with the stem portion and passing through the body portion to a plurality of exhaust outlets defined in the bit face, wherein at least one of the exhaust outlets is directed inwardly towards the center of the face of the bit, and a return outlet defined by the body portion and opening to the bit face which is in fluid communication through the bit with the central return passageway in the drill.

6. A bit as recited in claim 5 wherein the inwardly-directed exhaust outlet is formed by plugging a previously outwardly-directed exhaust outlet at the bit face and by providing a new opening to the bit face which intersects the previously formed outlet in the body portion of the bit.

7. A bit as recited in claim 5, having restricting means defined by said body portion adapted to reduce the flow of exhausted fluid from the exhaust outlets to an annulus defined in use between a hole bore and the drill, whereby substantially all exhausted fluid is circulated from the exhaust outlets to the central return passageway via the return outlet, in front of the face of the bit.

8. A bit as recited in claim 5, wherein the diameter of the return outlet where it communicates with the central return passageway is greater than the diameter of the return outlet where it opens to the bit face.

9. A reverse circulation percussive drill apparatus adapted for down-the-hole drilling comprising:

an outer wear sleeve;

a backhead assembly located at one end of the outer wear sleeve for connecting the drill apparatus to a double-walled drill string and to a source of pressure fluid to actuate the drill;

a fluid diverter mounted inside the outer wear sleeve adjacent to the backhead;

an inner tube concentric with the outer wear sleeve and extending into the fluid diverter defining at least part of a central return passageway in the drill apparatus;

a bit, defining a stem portion, a body portion and an external bit face, located by the stem portion thereof in a chuck mounting at the other end of the outer wear sleeve and slidably mounted on the said inner tube in an annular chamber defined between the outer wear sleeve and the inner tube, and by the diverter at one end, and the bit stem at the other end, wherein the bit defines a main fluid exhaust means comprising a duct defined between an outer surface of the bit stem and the chuck mounting and which then communicates with the external face of the bit through the body of the bit;

an inner sleeve mounted inside the outer wear sleeve towards said one end of the chamber adjacent to the diverter defining a fluid communication passage between the diverter and the chamber via porting means; and a piston slidably disposed in the said chamber with respect to the inner sleeve to cooperate with the porting means and mounted on the inner tube to reciprocate within the chamber so as to repeatedly deliver a blow to the bit, whereby substantially all exhausted fluid is conveyed via the main fluid exhaust duct directly to the face to the bit.

10. Drill apparatus as recited in claim 9, wherein said duct is defined by spaces between external splines on the bit and internal splines on the chuck.

11. Drill apparatus as claimed in claim 10 wherein the inner tube extends through the apparatus, at least the full length of the outer wear sleeve.

12. Drill apparatus as recited in claim 9 comprising a secondary fluid exhaust means defined by apertures in the bit communicating directly between the main fluid exhaust duct and the central return passageway, at a rearwardly directed angle thereto, adapted to continually direct a portion of the exhausted fluid directly to the central return passageway.

13. Drill apparatus as recited in claim 9 comprising an expansion chamber in the main fluid exhaust duct defined by a space between the bit and the chuck, wherein the secondary fluid exhaust duct communicates with the main fluid exhaust duct via the said expansion chamber.

14. A reverse circulation percussive drill apparatus adapted for down-the-hole drilling comprising:

an outer wear sleeve;

a backhead assembly located at one end of the outer wear sleeve for connecting the drill apparatus to a double-walled drill string and to a source of pressure fluid to actuate the drill;

a fluid diverter mounted inside the outer wear sleeve adjacent to the backhead;

an inner tube concentric with the outer wear sleeve and extending into the fluid diverter defining at least part of a central return passageway in the drill apparatus;

a bit located by a chuck at the other end of the outer wear sleeve slidably mounted on the said inner tube in an annular chamber defined by the outer wear sleeve, by the inner tube, the diverter at one end, and by the bit at the other end wherein the bit together with the inner tube define at least one main fluid exhaust duct communicating directly between the chamber and the face of the bit;

an inner sleeve mounted inside the outer wear sleeve towards said one end of the chamber adjacent to the diverter defining a fluid communication passage between the diverter and the chamber via porting means;

a piston slidably disposed in the said chamber with respect to the inner sleeve to cooperate with the porting means and mounted on the inner tube to reciprocate within the chamber so as to repeatedly deliver a blow to the bit;

by-pass means to exhaust fluid from the said other end of the chamber operable when the bit has fallen forward in the chuck beyond a pre-determined point of protraction thereby to arrest the piston temporarily until the bit has retracted, such that in the protracted condition substantially all the fluid which normally reciprocates the piston is re-routed directly to the main exhaust duct.

15. Drill apparatus as recited in claim 14 comprising a secondary fluid exhaust means defined by a first plurality of apertures in the inner tube communicating directly between the main fluid exhaust duct and the central return passageway, at a rearwardly directed angle thereto, adapted to continually direct a portion of the exhausted fluid directly to the central return passageway.

16. Drill apparatus as recited in claim 15 wherein the by-pass means comprise a second plurality of rearwardly directed apertures in the inner tube located forwardly of said first plurality of apertures, adapted to communicate between the main fluid exhaust duct and the central return passageway only when the bit is in the said protracted condition.

17. Drill apparatus as recited in claim 14, comprising a secondary fluid exhaust means defined by a first plurality of apertures in the bit communicating directly between the main fluid exhaust duct and the central return passageway, at a rearwardly directed angle thereto, adapted to continually direct a portion of the exhausted fluid directly to the central return passageway.

18. Drill apparatus as recited in claim 17 wherein the by-pass means comprise a second plurality of rearwardly-directed apertures in the bit located rearwardly of said first plurality of apertures, adapted to communicate between the main fluid exhaust duct and the central return passageway only when the bit is in the said protracted condition.

19. Drill apparatus as recited in claim 14 in which a choke to vent excess fluid pressure is located between the fluid diverter and the inner tube.

20. A bit for a reverse circulation down-the-hole drill, which defines a central return passageway, actuated by fluid under pressure adapted in use to be suspendably mountable in a chuck secured to the forward end of the drill, comprising a step portion slidably mountable within the chuck, and adapted to extend into the drill, a body portion extending from the stem portion to terminate in a bit face adapted to support abrading means, main fluid exhaust means comprising a duct defined between an inner throughbore surface of the stem portion and the outer surface of an inner tube in the drill which serves to define the central return passageway in the drill, and defined by the body portion so as to pass therethrough to communicate with a plurality of exhaust outlets defined in the bit face, and a return outlet defined by the body portion and opening to the bit face, which is in fluid communication through the bit with the central return passageway in the drill.

21. A bit as recited in claim 20 wherein the rearmost end of the stem portion is adapted for percussive contact with a female piston and is adapted to receive a footvalve for cooperation therewith.

22. A bit as recited in claim 20 wherein the bit face defines a recess allowing for fluid communication between an exhaust outlet and a return outlet.

23. A bit as recited in claim 20 wherein the bit face defines a central concavity.

24. A bit as recited in claim 23 wherein the return outlet is off-centre with respect to the bit face and a throughbore defined by the body portion of the bit.

25. A bit as recited in claim 24 wherein the said throughbore bifurcates within the body portion to define two off-centre return outlets at the face of the bit.

26. A bit as recited in claim 24 comprising a plurality of return outlets.

27. A bit as recited in claim 20, comprising restricting means defined by a peripheral part of the body portion adapted to reduce the flow of exhausted fluid from the exhaust outlets to an annulus defined in use between a hole bore and the drill, whereby a substantial proportion of all the exhausted fluid is circulated from the exhaust outlets to the central return passageway via the return outlet, in front of the face of the bit.

28. A bit as recited in claim 27 wherein the said peripheral part is unbroken.

29. A reverse circulation percussive drill apparatus adapted for down-the-hole drilling comprising:

an outer wear sleeve;

a backhead assembly located at one end of the outer wear sleeve for connecting the drill apparatus to a double-walled drill string and to a source of pressure fluid to actuate the drill;

a fluid diverter mounted inside the outer wear sleeve adjacent to the backhead;

an tube concentric with the outer wear sleeve and extending into the fluid diverter defining at least part of a central return passageway in the drill apparatus;

a bit, defining a stem portion, a body portion and an external bit face, located by the stem portion thereof in a chuck mounting at the other end of the outer wear sleeve and slidably mounted on the said inner tube in an annular chamber defined between the outer wear sleeve and the inner tube, and by the diverter at one end, and the bit stem at the other end, wherein the bit defines a main fluid exhaust means comprising a duct defined between an inner throughbore surface of the stem portion and the outer surface of the inner tube, and which passes through the body portion of the bit to communicate with a plurality of exhaust outlets defined in the bit face, an inner sleeve mounted inside the outer wear sleeve towards said one end of the chamber adjacent to the diverter defining a fluid communication passage between the diverter and the chamber via porting means;

a piston slidably disposed in the said chamber with respect to the inner sleeve to cooperate with the porting means and mounted on the inner tube to reciprocate within the chamber so as to repeatedly deliver a blow to the bit.

30. Drill apparatus as recited in claim 29 comprising a secondary fluid exhaust means defined between the main fluid exhaust duct and the central return passageway, at a rearwardly-directed angle thereto, adapted to continually direct a portion of the exhausted fluid directly to the central return passageway.

31. Drill apparatus as recited in claim 29 in which a choke to vent excess fluid pressure is located between the fluid diverter and the inner tube.

32. Drill apparatus as recited in claim 36, having means to provide a flexible fluid seal placed in a gap defined between the bit and its mounting in the drill, and fluid pressure relief exhaust means communicating between the main fluid exhaust means of the bit and the exterior of the sides of the bit.

33. In a reverse circulation down-the-hole drill, the combination comprising an outer wear sleeve;

a chuck mounted at one end of said sleeve; and a drill bit mounted within said chuck, said drill bit including a step portion having a central bore extending therethrough and being spaced from said chuck to define a fluid expansion chamber for receiving a working fluid, a body portion extending from said stem portion to terminate in a bit face adapted to support abrading means and having a passageway communicating said bit face with said bore, and at least one duct extending through said body portion to communicate said expansion chamber with at least one outlet in said bit face to exhaust a fluid through said body portion to said bit face.

* * * * *

UNITED STATES PATENT AND TRADEMARK OFFICE

CERTIFICATE OF CORRECTION

PATENT NO. : 4,819,746

DATED : April 11, 1989

INVENTOR(S) : John C. A. T. Brown, et al

It is certified that error appears in the above-identified patent and that said Letters Patent is hereby corrected as shown below:

Column 4, line 46 "firs" should be -first embodiment-
Column 5, line 8 "section" should be -section line-
Column 6, line 51 "22 the" should be -22 into the-
Column 7, line 33 "recommenced" should be -recommence.-
Column 8, line 32 "such" should be -such as-
Column 8, line 49 "and, down" should be -and down-
Column 12, line 59 "Jammed" should be -jammed-
Column 18, line 19 "defined between" should be -defined by apertures in the inner tube communicating directly between-
Column 18, line 39 "step" should be -stem-

Signed and Sealed this

Fifth Day of December, 1989

*Attest:*

JEFFREY M. SAMUELS

*Attesting Officer* *Acting Commissioner of Patents and Trademarks*